US009759478B2

(12) United States Patent
Parkes

(10) Patent No.: US 9,759,478 B2
(45) Date of Patent: Sep. 12, 2017

(54) LOCKER ASSEMBLY AND ASSOCIATED INSERT ASSEMBLY FOR A CABINET

(71) Applicant: Cold Rush Refrigerated Lockers Pty Ltd, Brighton Eventide (AU)

(72) Inventor: Dean Parkes, Brighton (AU)

(73) Assignee: COLD RUSH REFRIGERATED LOCKERS PTY LTD, Brighton Eventide, QLD (AU)

( * ) Notice: Subject to any disclaimer, the term of this patent is extended or adjusted under 35 U.S.C. 154(b) by 0 days.

(21) Appl. No.: 14/654,371

(22) PCT Filed: Dec. 18, 2013

(86) PCT No.: PCT/AU2013/001481
§ 371 (c)(1),
(2) Date: Jun. 19, 2015

(87) PCT Pub. No.: WO2014/094048
PCT Pub. Date: Jun. 26, 2014

(65) Prior Publication Data

US 2015/0345855 A1 Dec. 3, 2015

(30) Foreign Application Priority Data

Dec. 20, 2012 (AU) ..... 2012905569

(51) Int. Cl.
*F25D 23/00* (2006.01)
*F25D 23/06* (2006.01)
(Continued)

(52) U.S. Cl.
CPC ..... *F25D 23/069* (2013.01); *A47B 55/00* (2013.01); *A47B 71/00* (2013.01); *A47B 81/00* (2013.01);
(Continued)

(58) Field of Classification Search
CPC ..... F25D 23/025; F25D 23/069; F25D 23/02; F25D 23/028; F25D 23/04;
(Continued)

(56) References Cited

U.S. PATENT DOCUMENTS 618,846 A * 2/1899 Crowder ..... A47G 29/1201 232/24
693,770 A * 2/1902 Wright et al. ..... A47G 29/1209 232/17
(Continued)

FOREIGN PATENT DOCUMENTS

| | | | |
|---|---|---|---|
| DE | 3114980 | | 10/1982 |
| FR | 2408103 | | 6/1979 |
| WO | 9502796 | * | 1/1995 |

*Primary Examiner* — Janet M Wilkens
(74) *Attorney, Agent, or Firm* — Frank J. Bonini, Jr.; John F. A. Earley, III; Harding, Earley, Follmer & Frailey, P.C.

(57) ABSTRACT

A locker assembly insert (10) for a cabinet (11) (shown in phantom). In this case the cabinet (11) is a two door cabinet having a first door (12) and a second door (13) (these doors are shown open in FIG. 4), The cabinet has a base (14) opposite sides (15) (and 16), a back (17) and a top (18). A central mullion (19) having a rear cover plate divides the cabinet (11) down the middle and the doors (12) and (13) close the cabinet. The locker assembly insert (10) in this case is applied to a two door cabinet and has a central support member (20) (which is put in place by first removing the rear cover plate behind the central mullion (19), the rear cover plate is tucked in behind the central support member (20) before assembly allowing it to be reused if the refrigerator is ever restored to its original condition), a pair of vertical side rails (21) and (22), a pair of bases (23) and (24), a pair of tops (25) and (26). This gives the basic door frame. The insert is completed using vertical divider sets (27, 28 and 29) and ten door locker door assemblies (30) and (31).

8 Claims, 10 Drawing Sheets

(51) Int. Cl.

| | |
|---|---|
| ***F25D 25/02*** | (2006.01) |
| ***A47B 55/00*** | (2006.01) |
| ***A47B 71/00*** | (2006.01) |
| ***A47B 81/00*** | (2006.01) |
| ***E05B 65/02*** | (2006.01) |
| ***F25D 23/02*** | (2006.01) |
| ***A47F 3/04*** | (2006.01) |
| ***A47F 5/00*** | (2006.01) |
| ***E05G 1/08*** | (2006.01) |
| ***F25D 13/02*** | (2006.01) |

(52) U.S. Cl.

CPC ..... *A47F 3/04* (2013.01); *A47F 5/00* (2013.01); *E05B 65/025* (2013.01); *E05G 1/08* (2013.01); *F25D 13/02* (2013.01); *F25D 23/02* (2013.01); *F25D 25/02* (2013.01); *F25D 23/025* (2013.01); *F25D 2400/16* (2013.01)

(58) Field of Classification Search

CPC ..... F25D 25/02502; F25D 25/021; F25D 25/022; F25D 17/045; F25D 17/062; A47F 3/04; A47F 3/0404; A47F 3/0443; A47F 2003/046; A47F 5/005; A47F 5/132; A47F 7/144; A47B 57/58–57/588; A47B 65/10; A47B 65/15; A47B 96/04

USPC .... 312/128, 129, 116, 291, 292, 404, 407.1, 312/109, 293.2; 108/60; 211/184

See application file for complete search history.

(56) References Cited

U.S. PATENT DOCUMENTS

| | | | | | |
|---|---|---|---|---|---|
| 1,369,091 | A * | 2/1921 | Fifer | A47F 3/00 | 312/116 |
| 1,589,064 | A * | 6/1926 | Gearhart | F25D 23/025 | 312/308 |
| 1,642,533 | A * | 9/1927 | Beer | A47G 29/1201 | 232/25 |
| 1,645,103 | A * | 10/1927 | Gulick | F25D 23/025 | 312/291 |
| 1,723,460 | A * | 8/1929 | Beare | F25D 3/04 | 312/116 |
| 1,748,670 | A * | 2/1930 | Craft | F25D 23/025 | 312/291 |
| 1,863,625 | A * | 6/1932 | Fenstermaker | A47B 57/58 | 108/61 |
| 1,953,836 | A * | 4/1934 | Stevens | F25D 17/045 | 62/265 |
| RE20,300 | E * | 3/1937 | Warren | F25D 25/024 | 62/266 |
| 2,130,617 | A * | 9/1938 | Dockham | F25D 23/025 | 232/25 |
| 2,470,956 | A * | 5/1949 | Savidge | A47F 3/0404 | 312/291 |
| 3,019,620 | A * | 2/1962 | Costantini | F25D 17/06 | 62/382 |
| 3,279,618 | A * | 10/1966 | Bergstedt | A47F 1/12 | 211/59.2 |
| 3,754,408 | A * | 8/1973 | Littleton | F25D 17/06 | 62/302 |
| 4,304,101 | A * | 12/1981 | Gidseg | F25D 17/065 | 62/187 |
| 4,651,921 | A | 3/1987 | McKellar | | |
| 6,247,641 | B1 * | 6/2001 | Noblet | A47G 29/1201 | 232/17 |
| 6,889,894 | B2 | 5/2005 | Yong | | |
| 7,178,716 | B2 * | 2/2007 | Yong | A47G 29/1201 | 232/24 |
| 2005/0138955 | A1 * | 6/2005 | Okuda | F25D 23/025 | 62/441 |
| 2005/0275326 | A1 * | 12/2005 | Lim | F25D 25/024 | 312/408 |
| 2006/0151588 | A1 * | 7/2006 | Mikolajczyk | A47G 29/1201 | 232/24 |
| 2006/0226104 | A1 * | 10/2006 | Schmidt | A47F 5/005 | 211/184 |
| 2009/0236954 | A1 | 9/2009 | Kobayashi et al. | | |
| 2012/0206029 | A1 | 8/2012 | Zabbatino | | |
| 2012/0209763 | A1 | 8/2012 | Zabbatino | | |
| 2014/0230472 | A1 * | 8/2014 | Coradetti | F25D 29/008 | 62/125 |

* cited by examiner

ASSEMBLED VIEW

EXPLODED VIEW

ASSEMBLED VIEW

EXPLODED VIEW

LOCKER ASSEMBLY AND ASSOCIATED INSERT ASSEMBLY FOR A CABINET

TECHNICAL FILED

THIS INVENTION relates to a locker assembly and in particular but not limited to a locker assembly insert to fit a pre-existing cabinet. In one preferred, non-limiting, embodiment, the invention may be applied to a refrigerated cabinet.

BACKGROUND

In the present specification the expression "pre-existing" refers to a cabinet that is transformed from its ordinary use as a cabinet, into a locker assembly by application of the present invention. However, this transformative application of the invention is only a preferred version of the invention, it being appreciated that a purpose built cabinet as a locker assembly could be made fully functional in the factory and shipped, having the same construction as described generally herein. However, one application employs a simple construction of parts which facilitate flat packing and ease of transportation to sites that already have the existing cabinet.

Lockers have been around for at least 100 years. Therefore the present invention falls within a mature art, and consequently according to the applicant, there was no real problem extant at the filing date of the present application in need of solution. This means the inventor was the first to recognise the need for the present invention as an alternative to what went before. Therefore, the present invention is not considered deterministic in any way but rather originating with the inventor both in terms of recognition of the need, and the inventor's solution thereto, rather than to any notional problem as may be perceived ex-post facto during patent examination. A search of the prior art carried out by the Australian Patent Office revealed the following documents, US 201210209763 A1 (ZABBATINO); US 2012/0206029 A1 (ZABBATINO); DE 3114980 A1 (PHILIPP KIRSCH GMBH); FR 2408103 A1 (REDIES DIETHARD). The two ZABBATINO specifications describe a locker assembly where individual locker boxes are made up from walls and each having a front door and all slide into and fit into a refrigerator as a block. Each locker is a self-contained box within the main cabinet. This means they are all effectively independent even though the whole locker unit fits inside the refrigerator. The PHILIPP KIRSCH GMBH and REDIES DIETHARD specifications concern the use drawers in a refrigerator rather than doors. The drawers operate similar to a filing cabinet and similar to ZABBATINO each drawer represents a self-contained box inside the refrigerator. Each of these locker assemblies of the prior art operate on a different principle to applicant's assembly and consequently are considered background art only.

SUMMARY

In one aspect therefore, there is provided a locker assembly comprising a cabinet having a front, a back, sides, and a front opening in the cabinet, a locker door fitted into the opening, the locker door having a first main door, the main locker door having a plurality of locker doors and each locker door having a locker space behind the door. Preferably, the cabinet includes an exterior door closing upon the main locker door. Thus all the lockers behind the main door can be opened as a bank of doors or they can be individually opened. There may be more than one main door, for example there may be say four main doors inside the cabinet door each having four locker doors.

In another aspect there is provided, a locker assembly comprising, a cabinet having a front, back, sides and an internal wall, the front having a plurality of locker doors communicating with respective locker spaces behind the respective locker doors, spaced dividers being located inside the cabinet with the dividers and the inner wall of the cabinet defining the locker spaces. Thus the locker spaces are not independent boxes within the refrigerator cabinet but adjacent lockers share the inner wall of the cabinet In another aspect there is provided a refrigerated locker assembly comprising, a refrigerated cabinet having at least one closable door and there being a removable locker assembly insert positioned inside the refrigerated cabinet, the removable locker insert assembly comprising a locker door assembly and locker dividers located behind the door assembly, the door assembly comprising a plurality of locker doors disposed inside of the refrigerated cabinet door. Preferably, the refrigerated cabinet is a two door cabinet and each door of the cabinet has a respective removable locker assembly insert located inside. It should be understood that "removable" means that it is inserted into the cabinet and could be removed without substantially altering the operation of the cabinet but this could involve the use of fasteners which have to be removed or parts of the insert that have to be disassembled.

In a still further aspect there is provided a locker assembly insert for a cabinet, the insert comprising a door frame, doors and dividers, the dividers comprising a first set of spaced vertical dividers dividing the space behind the doors into adjacent vertically extending spaces. In a preferred form the space is divided into a matrix of spaces by horizontal and vertical dividers assembled from horizontal and vertical divider components. Typically, the insert includes at least one base section, the base section having a base section vertical divider attachment means, in order to attach a vertical divider to the at least one base section. Typically, the insert includes at least one top section located above the base, and including a top section vertical divider attachment means to attach a vertical divider to the top section. Typically, each vertical divider has a horizontal divider coupling means, the coupling means being located at the juncture between horizontal and vertical dividers. The horizontal dividers are preferably wire shelves. Preferably, each horizontal divider is shared by at least two lockers. Preferably, each coupling means comprises upper and lower co-operating coupling rails. Typically, each coupling rail includes spaced slots and each divider includes spaced tabs and these are received in the slots.

In one preferred embodiment, there is provided a flat pack of components packaged for transport to be assembled in a cabinet onsite, and comprising, a locker door assembly being a substantially flat assembly including a matrix like box grid frame, the box grid frame having an outer peripheral frame and cross frame members defining grid spaces, each grid space having a locker door pivoted to the frame in each of the grid spaces, vertical frame members comprising rails adapted to be set vertically on opposite sides of the door assembly and to extend between the base section and the top section, dividers comprising flat plates, divider coupling rails, the base and top sections being substantially flat sections, the arrangement being such that the top, base, dividers, divider coupling rails, vertical frame rails and door assembly are shipped flat unassembled and assembled and added to the cabinet onsite. In the case where the components are assembled into the cabinet, where components are required to navigate around obstacles or parts of the existing cabinet which would otherwise be an obstacle those components being placed and positioned, the components are pre-cut or pre-formed with the parts of the existing cabinet in mind, so that the components may accommodate the cabinet with a non-invasive or the least amount of work being needed on the existing cabinet for the components to be put in place.

Preferably, the dividers comprise plates with spaced tabs as the coupling rail attachment means and the coupling rails have co-operating slots.

Preferably, the top and base sections have slots co-operating with tabs on the dividers.

Preferably, the door assembly comprises an outer peripheral door frame and an inner peripheral door frame carrying all the doors, the inner door frame being pivotally coupled to the outer peripheral door frame so that all the doors may be opened as a unit and locked as a unit. Each door in this embodiment is pivotally coupled to the inner door frame. The outer peripheral door frame typically comprises an underside marginal portion of the top section, an upper marginal portion of the base section and opposed vertical upright frame members on each side of the door.

In a preferred application the present invention may be applied to a refrigerated locker assembly having a cabinet, the cabinet have a cooled space divided vertically by horizontally spaced dividers, an airflow passage means for flow of air through the cooled space, the airflow passage means comprising an intake communicating with a manifold and plural vertically spaced outlets communicating between the manifold and the cooled space. Preferably, the intake is adjacent the top of the cabinet and the locker assembly has a perforated top section adjacent the intake. Preferably, the outlets extend across the cooled space as sets of outlets on either side of a central vertical divider. Preferably, the refrigerated locker has air flow though shelves, these are typically wire grill type shelves. In the case of a two door refrigerator, there is preferably a central vertical mullion between the doors, and the locker assembly includes a channel shaped upright locatable around the mullion and used to support the locker assembly on the inside of the mullion. The doors then close and operate as the seal for the cooled space as if the lockers were not present.

BRIEF DESCRIPTION OF THE DRAWINGS

In order that the present improvements may be more readily understood and put into practical effect reference will now be made to the accompanying drawings which illustrate preferred embodiments of the invention and wherein:—

METHOD OF PERFORMANCE

Figure 1:
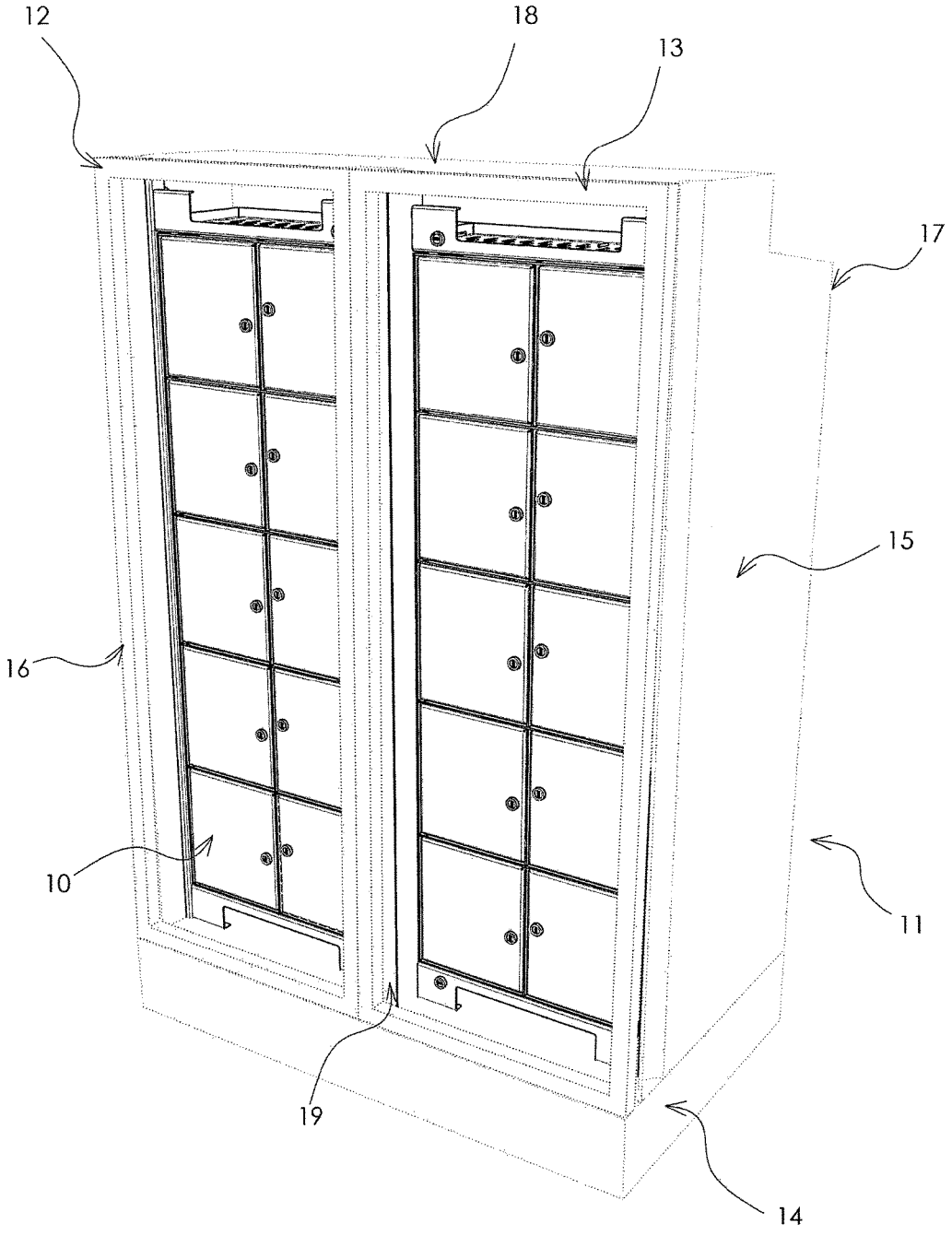
FIG. 1 is a front pictorial view of a locker assembly for a cabinet, the cabinet being shown in phantom.
Figure 2:
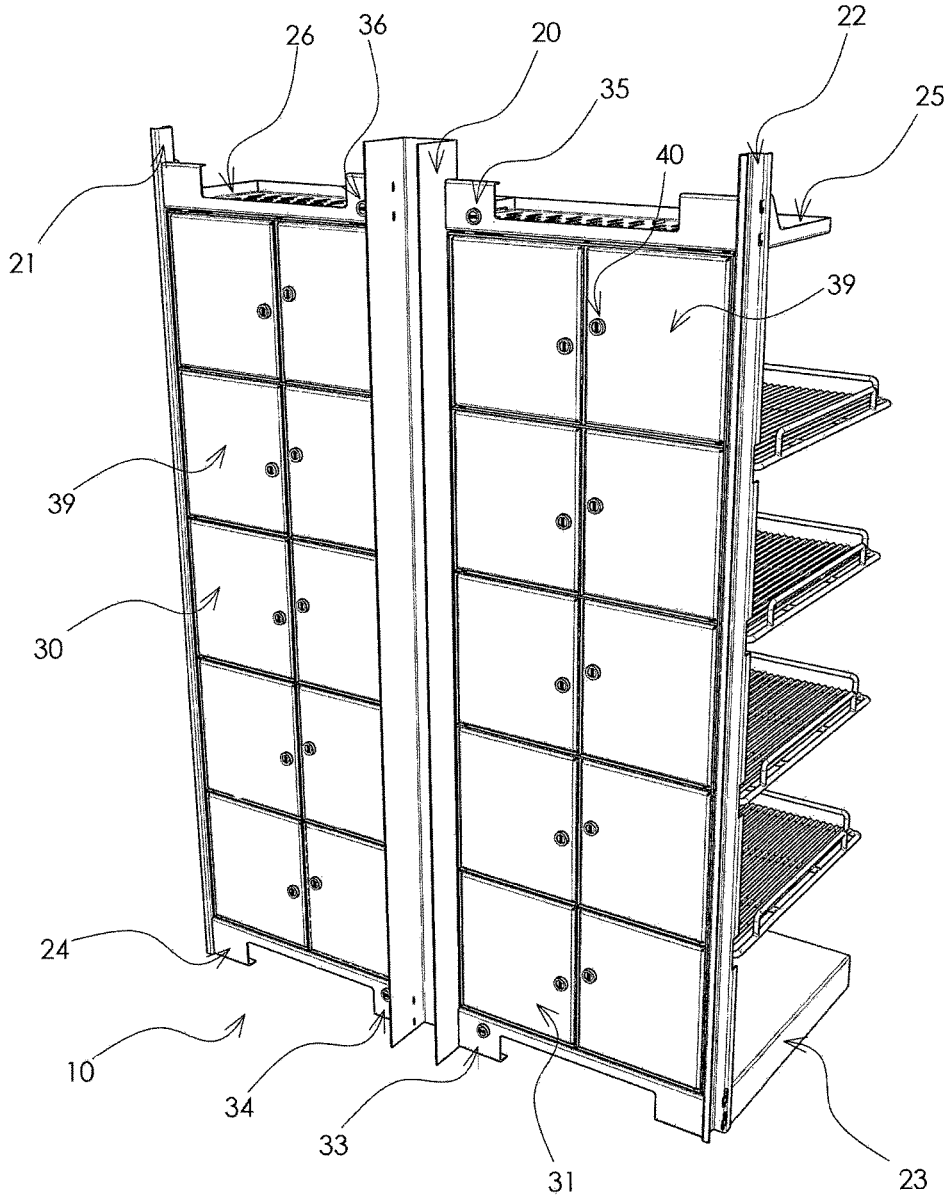
FIG. 2 is a is a view similar to FIG. 1 but with the cabinet lines have been removed showing the assembled insert.

Referring to the drawings and initially to FIGS. 1-4 there is illustrated a locker assembly insert 10 for a cabinet 11 (shown in phantom). In this case the cabinet 11 is a two door cabinet having a first door 12 and a second door 13 (these doors are shown open in FIG. 4). The cabinet has a base 14 opposite sides 15 and 16, a back 17 and a top 18. A central mullion 19 having a rear cover plate divides the cabinet 11 down the middle and the doors 12 and 13 close the cabinet from the position shown in FIG. 4 to the position shown in FIG. 1.

It should be appreciated that when applied to a refrigerator the doors 12 and 13 provide the refrigerator seal in the usual way. The description below will deal with application of the present invention to a two door refrigerator but the invention could be applied to any cabinet. However, in the case of a refrigerated cabinet the relative dimensions, air inlets and vents, the relative disposition of the refrigeration elements and the parts of the insert are selected to optimise airflow and cooling characteristics for the example of a two door refrigerated cabinet given herein. It will be appreciated that in this example the components of the locker assembly are arranged to minimise interference with the normal operation of the refrigerator but this is only exemplary and it should be appreciated that the invention embraces the broad concept as modified for other refrigerator configurations that might have different air flow characteristics.

The locker assembly insert 10 in this case is applied to a two door cabinet and has a central support member 20 (which is put in place by first removing the rear cover plate behind the central mullion 19, the rear cover plate is tucked in behind the central support member 20 before assembly allowing it to be reused if the refrigerator is ever restored to its original condition), a pair of vertical side rails 21 and 22, a pair of bases 23 and 24, a pair of tops 25 and 26. This gives the basic door frame. The insert is completed using vertical divider sets 27, 28 and 29 and ten door locker door assemblies 30 and 31. The wire shelves 32, there being eight of these illustrated, are usually supplied with the refrigerator and accordingly are not part of the insert, however the invention also embodies the whole combination of a locker assembly inclusive of the cabinet with the insert shown whether they be assembled from the same parts illustrated below or configured from other parts to give the equivalent, or substantially equivalent result.

Figure 4:
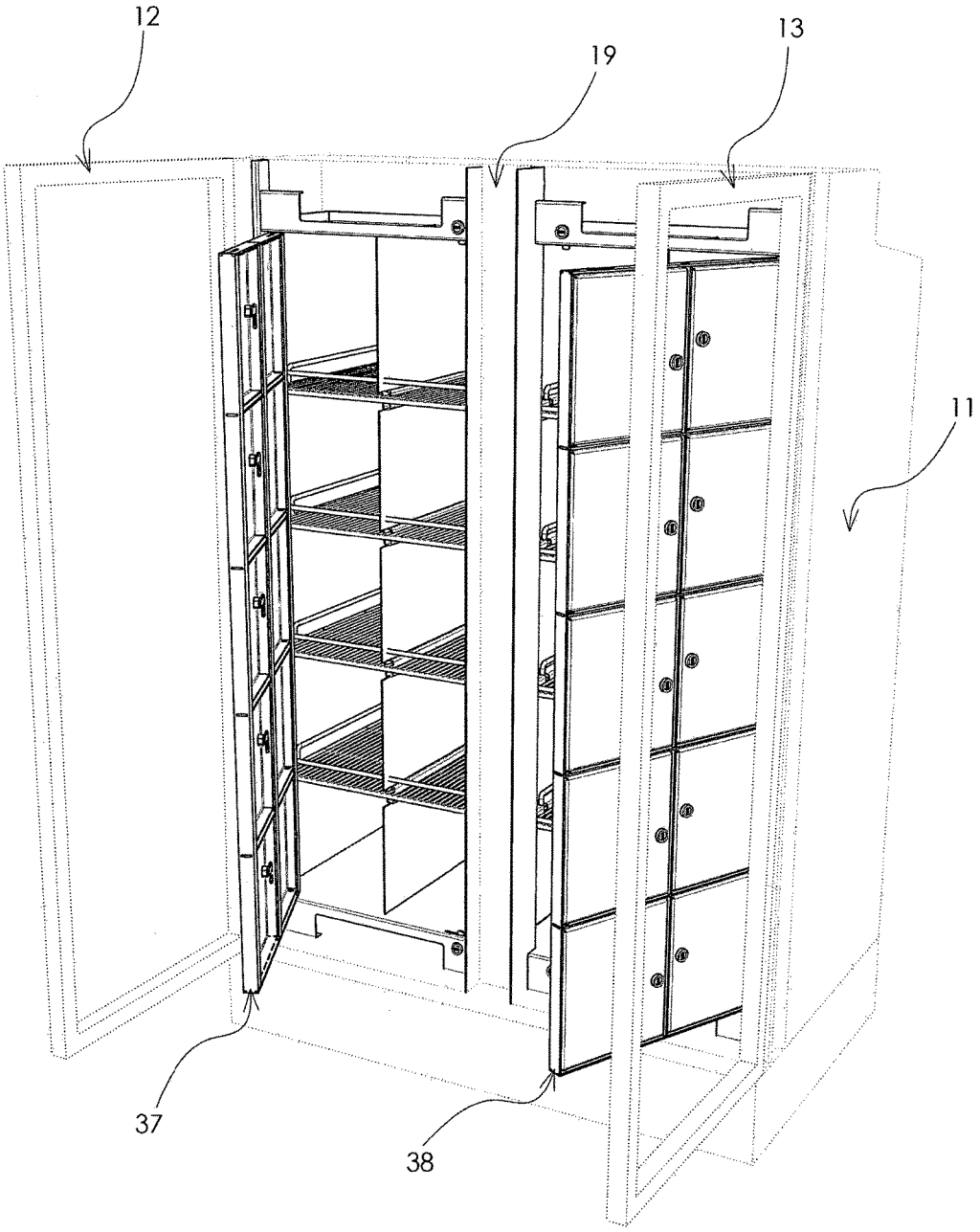
FIG. 4 is a pictorial view showing operation of the main insert doors in an environment where there are further external doors, as in a two door refrigerated locker assembly.
Figure 5:
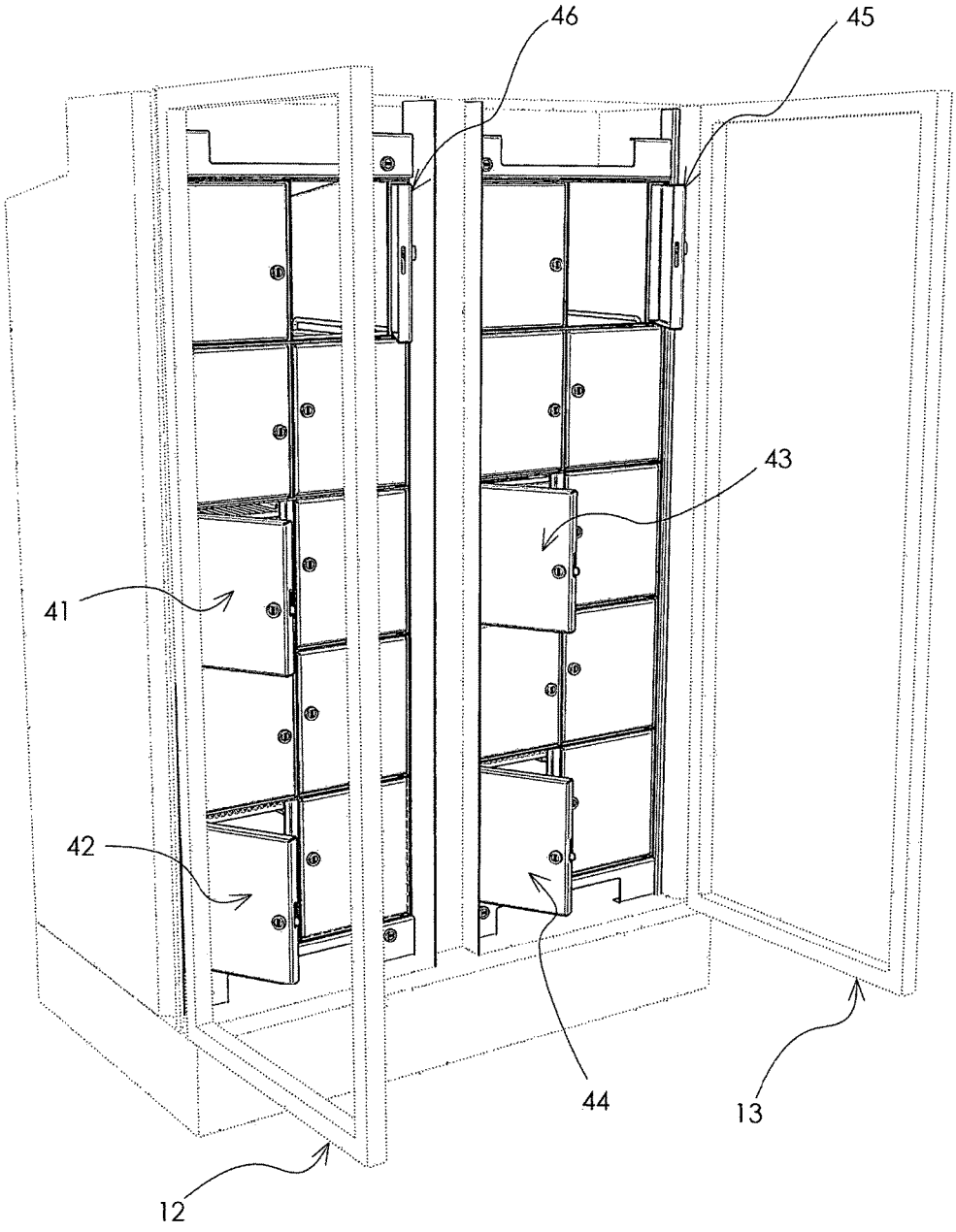
FIG. 5 is a drawing similar to FIG. 4 showing operation of the individual locker doors.

FIG. 4 illustrates the locker door assemblies 30 and 31 open. The tops and bases 23-26 have locks 33-36 so that the outer door frames 37 and 38 may be locked. This permits the use of master keys, pass card or other electronic means to open all the doors at once. The individual doors 39 (only one numeral is used) are individually locked with locks 40 so a master key can be used to unlock and open all the doors as a main door 30 and 31 with the individual users having separate keys pass card or other electronic means for the doors 39, six of these doors 41-46 are shown open in FIG. 5.

Figure 6:
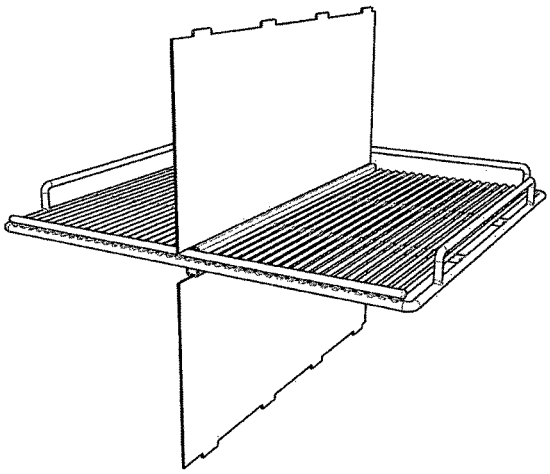
FIGS. 6, 7 and 8 are exploded views showing how the insert is assembled, in respect of the shelving and dividers in FIGS. 6 and 7, and with respect to the base, doors and top in FIG. 8.
Figure 6:
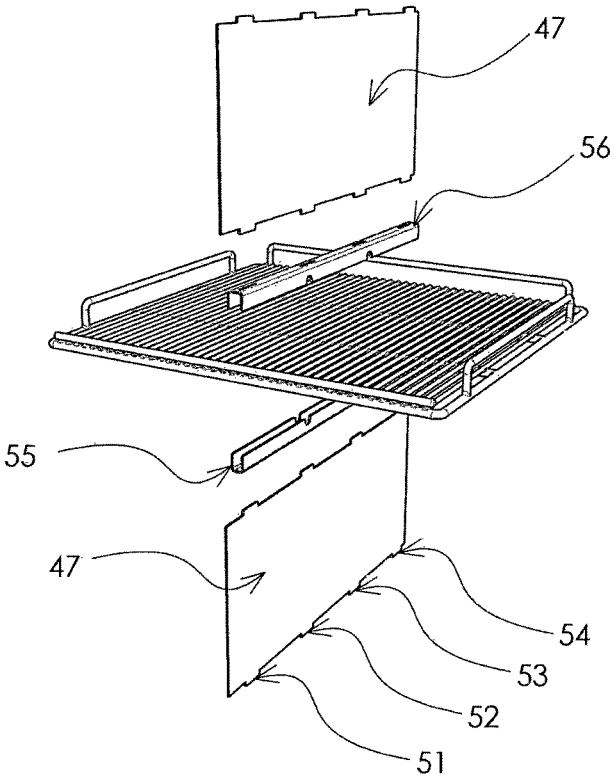
Figure 7:
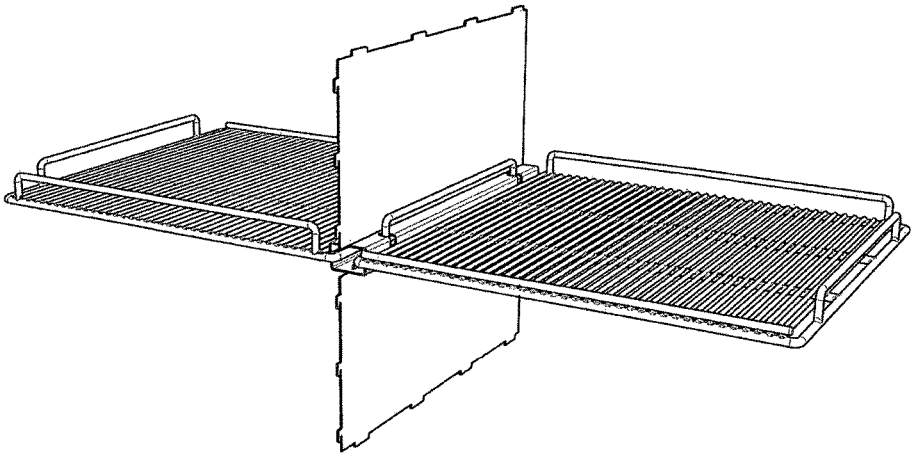
Figure 7:
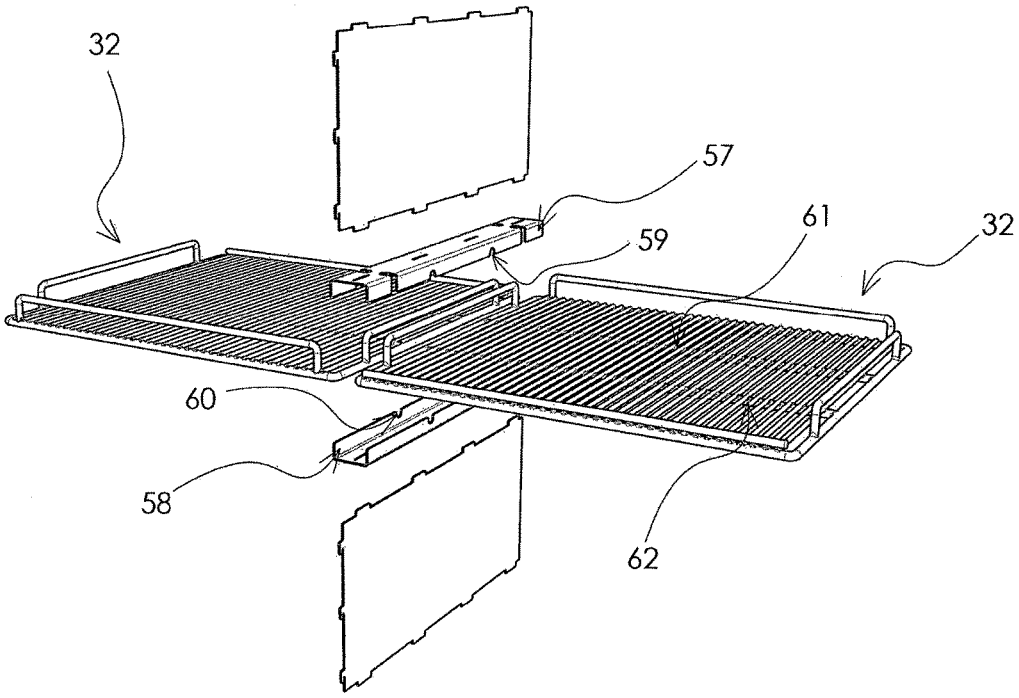
Figure 8:
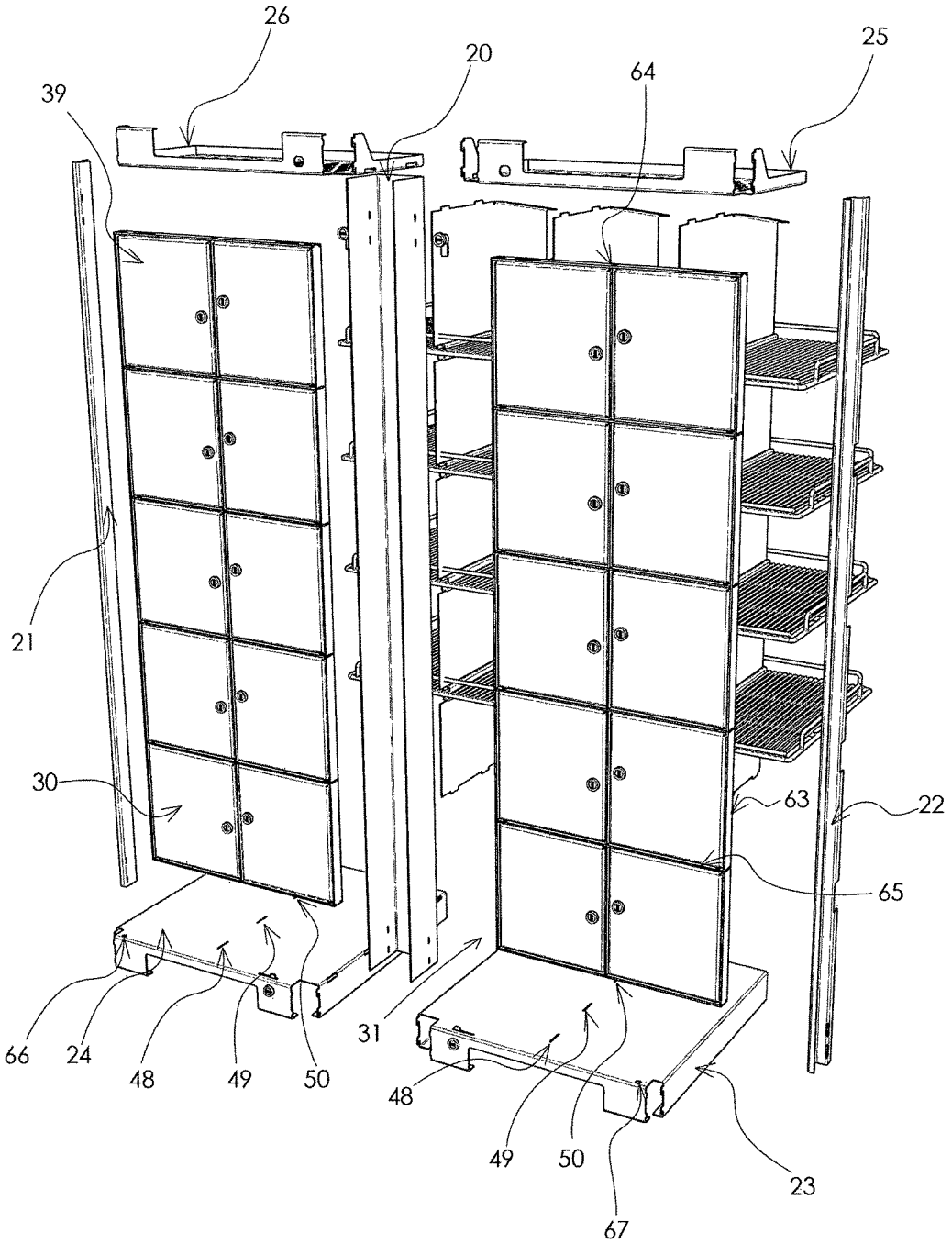

FIGS. 6-8 show the assembly method by which an insert is located inside the two door cabinet 11. In the illustrated embodiment the parts are made from metal, typically stainless steel, but any material suited to the purpose may be used. If the assembly were to be used in a lunchroom the parts might be plastic in a more secure situation as in blood storage facility they might be stainless steel.

Figure 3:
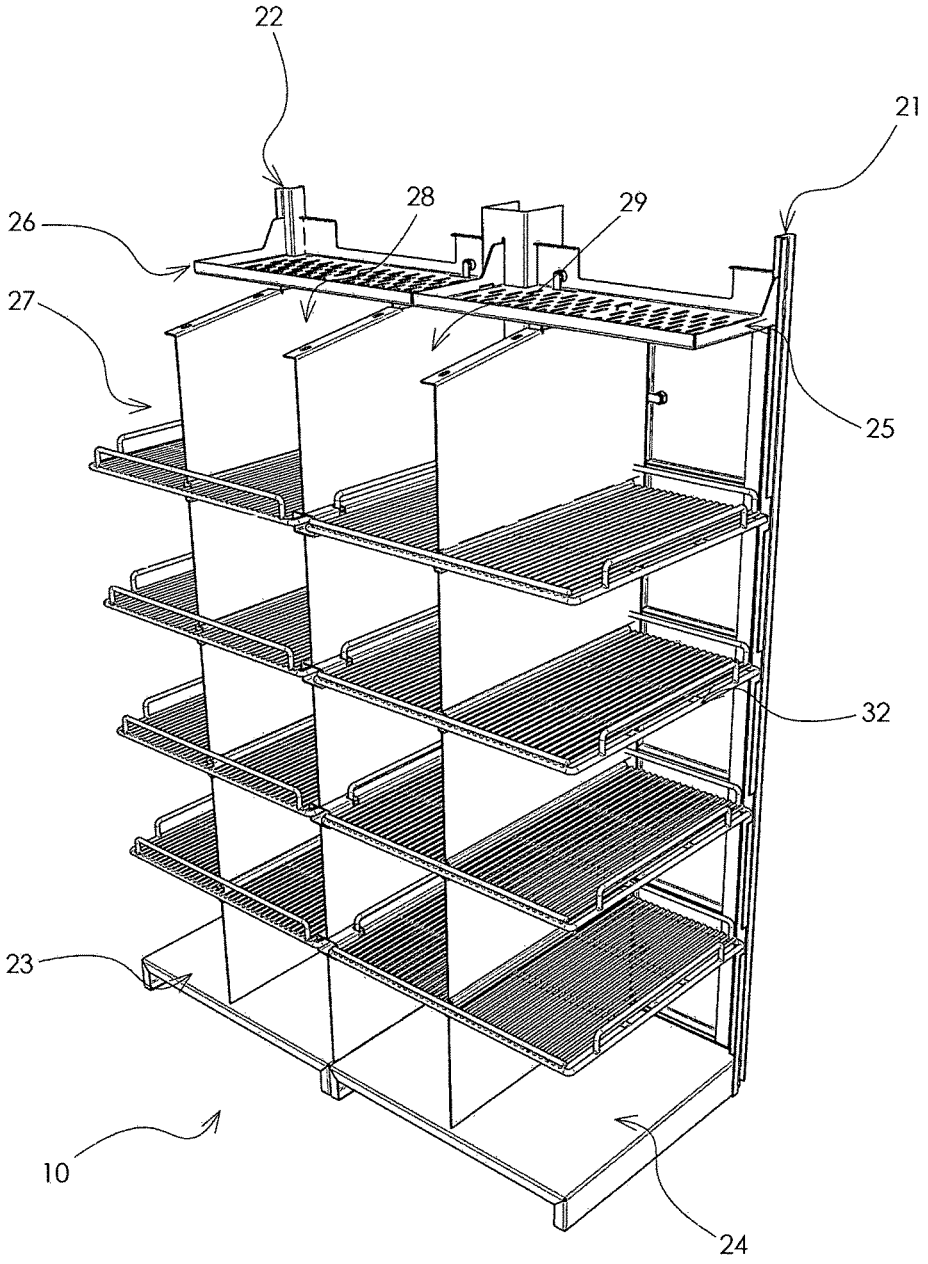
FIG. 3 is a pictorial view of the insert of FIG. 2 from the back.

As depicted in FIGS. 3 and 4 each of the divider sets 27, 28 and 29 comprises five dividers 47. Each of bases 23 and 24 has spaced slots 48, 49 and 50. These take tabs 51, 52 and 53. A further slot in each base that is not visible in FIG. 8 but this is present and takes tab 54 on the divider. Lower and upper divider coupling rails 55 and 56 are similarly slotted to take tabs and to thereby receive the divider 47' and so on this is repeated to build up the set. The coupling rails are U-shaped and fit over the central wire in a wire shelf 32. Where two wire shelves 32 meet, divider coupling rails 57 and 58 as depicted in FIG. 7 are used in a similar fashion to the coupling rails 55 and 56. The coupling rails 57 and 58 are slightly wider. The coupling rails are rolled, folded or moulded and include spaced grooves such as shown at 59 and 60 which aid to assist localisation of the coupling rails over cross wires 61 and 62 of the wireframe shelves 32. Other grooves and slots shown are to fit around the wires.

Each door 30 and 31 is formed as a grid frame having an outer peripheral frame 63, a central frame member 64 and four cross frame members 65, these together form a grid for the individual locker doors 39. Each door assembly 30 and 31 has a pivot pin top and bottom locatable in holes 66 and 67 in the bases 23 and corresponding holes in the top sections 24. Thus as illustrated in FIG. 8, where a refrigerated cabinet is already equipped with two doors and wire formed shelves 32, the locker assembly insert may be shipped as a flat pack and the refrigerator may be transformed into a refrigerated locker assembly by using the present invention. Since vertical dividers are the only parts that enter the cooled space as long as the air flow is vertical and the outlets into the space are uniform across the space the cooling characteristics of the refrigerator remain effectively the same. An example is given below.

Figure 9:
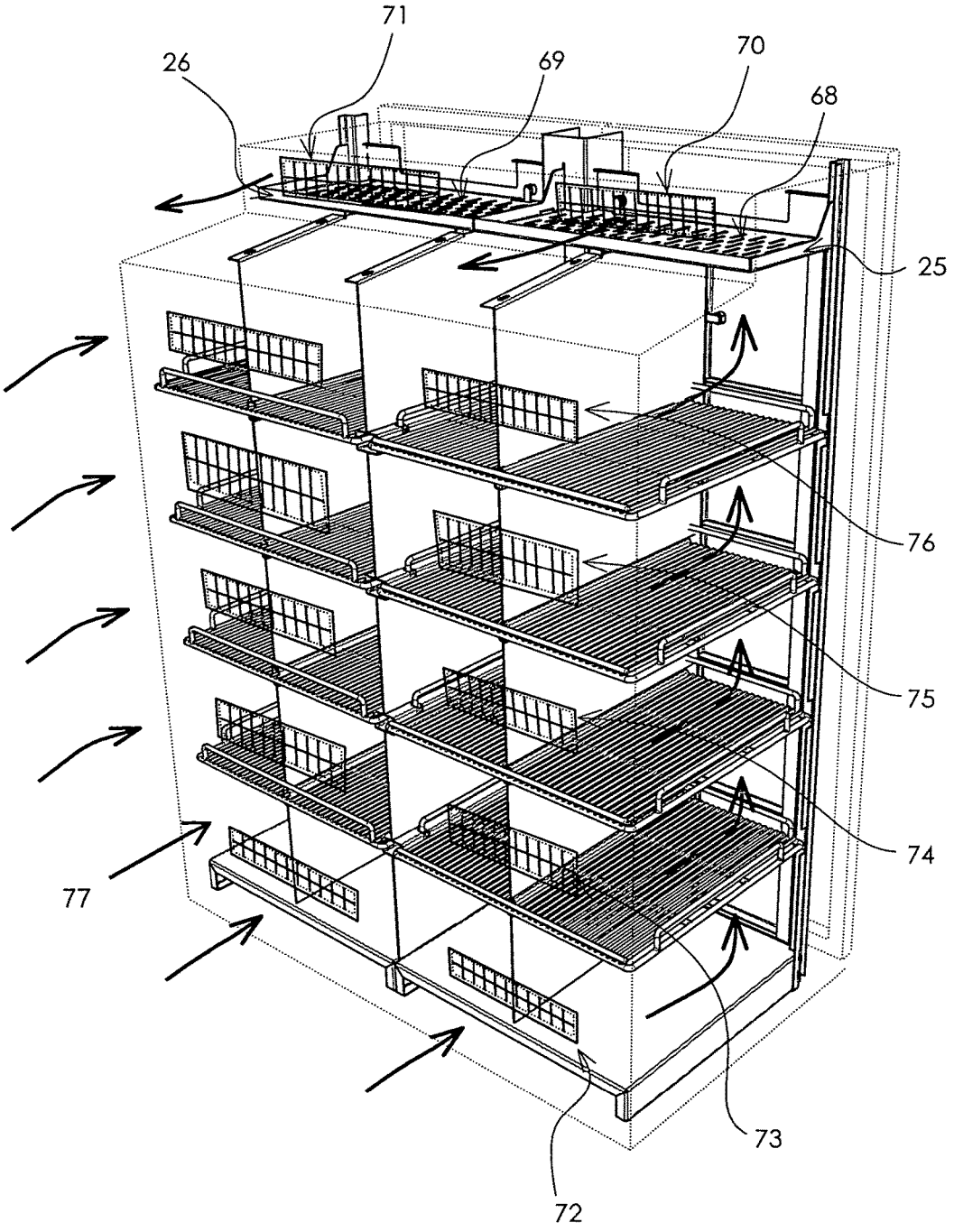
FIGS. 9, 10 and 11 illustrate flow of air during application of the insert of FIG. 1-8 to a refrigerated cabinet FIG. 10 being a section through A-A of FIG. 11.
Figure 11:
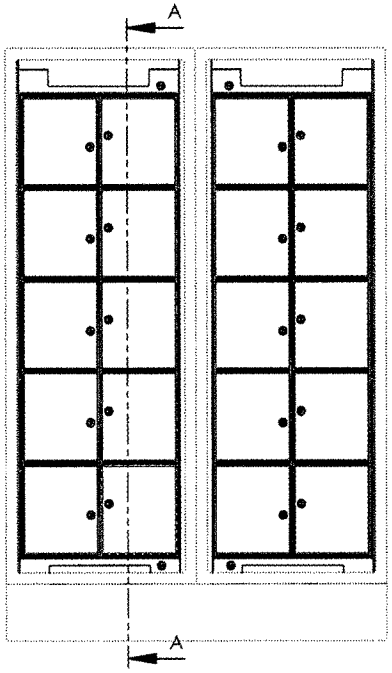
Figure 10:
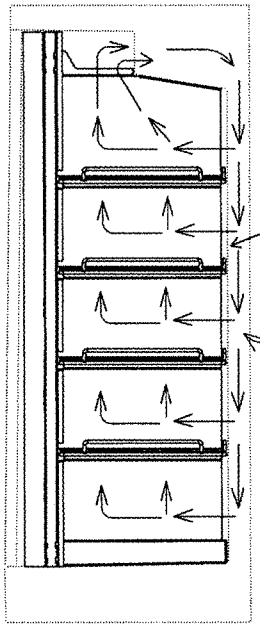

Referring to FIGS. 9 and 10 the circulation of cool air is illustrated in relation to the arrows shown in the drawings. In particular the top sections 25 and 26 have respective grilles 68 and 69 and these are located adjacent top intake grilles 70 and 71 of the refrigerated cabinet. The cabinet itself has a rear manifold 71 and there are back outlet grilles 72, 73, 74, 75, and 76 on one side and the same on the opposite side, so that inner wall 77 (shown in phantom) of the cabinet is shared by the locker spaces. These grilles bridge across the vertical dividers as concerns the sets 27 and 29. Air then flows up through the wire shelves 32 to the intakes 70 and 71.

Whilst the above has been given by way of illustrative example many variations and modification will be apparent to those skilled in the art without departing from the broad ambit and scope of the invention as herein set forth. For example, the number and types of spaces and doors could be of any configuration, one side may have five full width lockers and one side may have ten half width lockers as a combo, or one whole fridge may have five full width lockers on each side, ten in total, and so on. Further, any shape of cabinet may be accommodated using a suitably modified variation of the present invention.

The invention claimed is:

1. A locker assembly in a cabinet having a front, a back, sides, and a front opening in the cabinet, characterized in that a locker door is fitted into the opening, the locker door having at least one main locker door, the main locker door having a plurality of locker doors within it and each of said plurality of locker doors having a locker space behind the main locker door the locker assembly being made from a flat pack of components packaged for transport and assembled in the cabinet onsite, the locker door being a substantially flat assembly including a matrix being a box grid frame, the box grid frame having an outer peripheral frame and cross frame members defining grid spaces, each grid space having a said one of said plurality of locker doors pivoted to the frame in each of the grid spaces, the components further including a base section and a top section, vertical frame members comprising rails adapted to be set vertically on opposite sides of the locker door assembly and to extend between the base section and the top section, dividers comprising flat plates, divider coupling rails, the base and top sections being substantially flat sections, the arrangement being such that the top section, the base section, the dividers comprising flat plates, the divider coupling rails, the vertical frame members fails and the locker door assembly are shipped flat unassembled and assembled and added to the cabinet onsite, inn the case where the components are assembled into the cabinet, where components are required to navigate around obstacles or parts of the existing cabinet which would otherwise be an obstacle to those components being placed and positioned, the components are pre-cut or pre-formed with the parts of the existing cabinet in mind, so that the components may accommodate the cabinet with a non-invasive or the least amount of work being needed on the existing cabinet for the components to be put in place.

2. A locker assembly in a cabinet having a front, a back, sides, an inner wall and a front opening in the cabinet, characterized in that a locker door is fitted into the opening, the locker door having at least one main door, the main locker door having a plurality of locker doors within it and each locker door having a locker space behind the main locker door, the locker assembly including spaced dividers being located inside the cabinet with the dividers and the inner wall of the cabinet defining the locker spaces so that adjacent locker spaces share the inner wall of the cabinet wherein the dividers comprise plates with coupling rails securing them, the plates having spaced tabs and coupling rail attachment means and the coupling rails have co-operating slots receiving the tabs.

3. A locker assembly in a cabinet having a front, back, sides and an internal wall, the front having a plurality of locker doors communicating with respective locker spaces behind the respective locker doors, spaced dividers being located inside the cabinet characterized in that the dividers and the inner wall of the cabinet define the locker spaces so that adjacent locker spaces share as their inner wall, the inner wall of the cabinet, the locker assembly being made from a flat pack of components packaged for transport and assembled in the cabinet onsite, and comprising, a locker door assembly being a substantially flat assembly including a matrix being a box grid frame, the box grid frame having an outer peripheral frame and cross frame members defining grid spaces, each grid space having a said one of said plurality of locker doors pivoted to the frame in each of the grid spaces, the components further including a base section and a top section, vertical frame members comprising rails adapted to be set vertically on opposite sides of the locker door assembly and to extend between the base section and the top section, the said dividers comprising flat plates, divider coupling rails, the base and top sections being substantially flat sections, the arrangement being such that the top section, the base section, the dividers comprising flat plates, the divider coupling rails, the vertical frame members and the locker door assembly are shipped flat unassembled and assembled and added to the cabinet onsite, in the case where the components are assembled into the cabinet, where components are required to navigate around obstacles or parts of the existing cabinet which would otherwise be an obstacle to those components being placed and positioned, the components are pre-cut or pre-formed with the parts of the existing cabinet in mind, so that the components may accommodate the cabinet with a non-invasive or the least amount of work being needed on the existing cabinet for the components to be put in place.

4. A locker assembly in a cabinet having a front, back, sides and an internal wall, the front having a plurality of locker doors communicating with respective locker spaces behind the respective locker doors, spaced dividers being located inside the cabinet characterized in that the said spaced dividers and the inner wall of the cabinet define the locker spaces so that adjacent locker spaces share as their inner wall, the inner wall of the cabinet, wherein the said spaced dividers comprise plates with coupling rails securing them, the plates having spaced tabs and coupling rail attachment means and the coupling rails have co-operating slots receiving the tabs.

5. A locker assembly in a cabinet having a front, back, sides and an internal wall, the front having a plurality of locker doors communicating with respective locker spaces behind the respective locker doors, spaced dividers being located inside the cabinet characterized in that the dividers and the inner wall of the cabinet define the locker spaces so that adjacent locker spaces share as their inner wall, the inner wall of the cabinet, wherein the main door comprises an outer peripheral door frame and an inner peripheral door frame carrying all the doors, the inner door frame being pivotally coupled to the outer peripheral door frame so that all the doors within the main door may be opened as a unit and locked as a unit, each door being pivotally coupled to the inner door frame, the outer peripheral door frame comprises an underside marginal portion of a top section, an upper marginal portion of a base section and opposed vertical upright frame members on each side of the main door.

6. A locker assembly in a refrigerated cabinet having at least one closable door and the locker assembly positioned inside the refrigerated cabinet, characterized in that the locker assembly comprises a locker door assembly and locker dividers located behind the door assembly, the door assembly comprising a plurality of locker doors disposed inside of the refrigerated cabinet door, the refrigerated cabinet have a cooled space divided vertically by horizontally spaced dividers, an airflow passage means for flow of air through the cooled space, the airflow passage means comprising an intake communicating with a manifold and plural vertically spaced outlets communicating between the manifold and the cooled space, wherein the refrigerated cabinet is a two door refrigerator, there being a central vertical mullion between the doors, and the locker assembly includes a channel shaped upright locatable around the mullion and used to support the locker assembly on the inside of the mullion, the doors then close and operate as the seal for the cooled space as if lockers were not present.

7. A locker assembly in a refrigerated cabinet having at least one closable door and the locker assembly being positioned inside the refrigerated cabinet, characterized in that the locker assembly comprises a locker door assembly and locker dividers located behind the locker door assembly, the locker door assembly further comprising a plurality of locker doors disposed inside of the refrigerated cabinet door, the refrigerated cabinet have a cooled space divided vertically by horizontally spaced dividers, an airflow passage means for flow of air through the cooled space, the airflow passage means comprising an intake communicating with a manifold and plural vertically spaced outlets communicating between the manifold and the cooled space, the locker assembly being made from a flat pack of components packaged for transport and assembled in the cabinet onsite, the locker door assembly being a substantially flat assembly including a matrix being a box grid frame, the box grid frame having an outer peripheral frame and cross frame members defining grid spaces, each grid space having a said one of said plurality of locker doors pivoted to the frame in each of the grid spaces, the components further including a base section and a top section, vertical frame members comprising rails adapted to be set vertically on opposite sides of the locker door assembly and to extend between the base section and the top section, the said locker dividers comprising flat plates, divider coupling rails, the base and top sections being substantially flat sections, the arrangement being such that the top section, the base section, the dividers comprising flat plates, the divider coupling rails, the vertical frame members and the locker door assembly are shipped flat unassembled and assembled and added to the cabinet onsite, in the case where the components are assembled into the cabinet, where components are required to navigate around obstacles or parts of the existing cabinet which would otherwise be an obstacle to those components being placed and positioned, the components are pre-cut or pre-formed with the parts of the existing cabinet in mind, so that the components may accommodate the cabinet with a non-invasive or the least amount of work being needed on the existing cabinet for the components to be put in place.

8. A locker assembly in a refrigerated cabinet, the refrigerated cabinet having an inner wall and at least one closable door, the locker assembly being positioned inside the refrigerated cabinet, characterized in that the locker assembly comprises a locker door assembly and locker dividers located behind the door assembly, the locker door assembly comprising a plurality of locker doors disposed inside of the refrigerated cabinet door, the refrigerated cabinet have a cooled space divided vertically by horizontally spaced dividers, an airflow passage means for flow of air through the cooled space, the airflow passage means comprising an intake communicating with a manifold and plural vertically spaced outlets communicating between the manifold and the cooled space, the spaced locker dividers being located inside the cabinet with the locker dividers and the inner wall of the cabinet defining locker spaces so that adjacent locker spaces share the inner wall of the cabinet wherein the locker dividers comprise plates with coupling rails securing them, the plates having spaced tabs and coupling rail attachment means and the coupling rails have co-operating slots receiving the tabs.

* * * * *